US006333623B1

(12) United States Patent
Heisley et al.

(10) Patent No.: US 6,333,623 B1
(45) Date of Patent: Dec. 25, 2001

(54) COMPLEMENTARY FOLLOWER OUTPUT STAGE CIRCUITRY AND METHOD FOR LOW DROPOUT VOLTAGE REGULATOR

(75) Inventors: David A. Heisley; Tony R. Larson, both of Tucson, AZ (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/703,183

(22) Filed: Oct. 30, 2000

(51) Int. Cl.[7] ..... G05F 1/40
(52) U.S. Cl. ..... 323/280; 323/281; 323/224
(58) Field of Search ..... 323/280, 273, 323/281, 315, 316, 224

(56) References Cited

U.S. PATENT DOCUMENTS

| | | | |
|---|---|---|---|
| 4,779,037 | 10/1988 | LoCascio | 323/275 |
| 5,061,862 | 10/1991 | Tamagawa . | |
| 5,414,341 | 5/1995 | Brown | 323/268 |
| 5,608,312 | 3/1997 | Wallace | 323/224 |
| 5,637,992 | 6/1997 | Edwards | 323/315 |
| 5,850,139 * | 12/1998 | Edwards | 323/280 |
| 5,864,227 | 1/1999 | Borden et al. | 323/280 |
| 5,867,015 | 2/1999 | Corsi et al. | 323/316 |
| 5,912,550 | 6/1999 | Sharpe-Geisler | 323/273 |
| 5,945,818 | 8/1999 | Edwards | 323/273 |
| 5,966,004 * | 10/1999 | Kadanka | 323/271 |
| 5,982,226 | 11/1999 | Rincon-Mora | 327/541 |
| 5,986,910 | 11/1999 | Nakatsuka | 363/73 |
| 6,034,519 | 3/2000 | Yang | 323/316 |
| 6,188,211 * | 2/2001 | Rincon-Mora et al. | 323/280 |

* cited by examiner

*Primary Examiner*—Shawn Riley
(74) *Attorney, Agent, or Firm*—W. Daniel Swayze, Jr.; W. James Brady; Frederick J. Telecky, Jr.

(57) ABSTRACT

A low drop-out ("LDO") voltage regulator includes an output stage of having a pass device and a discharge device arranged in complementary voltage follower configurations to both source load current to and sink load current from a regulated output voltage conductor. The pass device and the discharge device are controlled through a single feedback loop.

24 Claims, 6 Drawing Sheets

COMPLEMENTARY FOLLOWER OUTPUT STAGE CIRCUITRY AND METHOD FOR LOW DROPOUT VOLTAGE REGULATOR

BACKGROUND OF THE INVENTION

1. Field of the Invention

The present invention relates generally to low dropout ("LDO") voltage regulators. More particularly, the present invention relates to improvements in LDO voltage regulators that use a "follower" connected pass element to address the problems of output over-voltage conditions and instability at low output currents.

2. State of the Art

The function of a voltage regulator is to take a varying input voltage supply and generate a stable output voltage. The efficiency of modern power supply systems, particularly battery powered supply systems, is directly related to the amount of power dissipated in the voltage regulator. Minimizing the power consumption is a key parameter in regulator design. The primary method for reducing power consumption is to reduce the voltage drop across the linear regulator. The lowest voltage drop the regulator can tolerate before loss of regulation occurs is called the "dropout voltage" and a low dropout voltage is very desirable. For battery powered systems, power is limited and efficiency is of key importance. Thus, the design of an efficient system that utilizes linear regulation necessarily includes a low dropout ("LDO") voltage regulator.

As shown in FIG. 1, a linear voltage regulator 2 conventionally includes an amplifier 4 which compares the output of a voltage reference 6 to a sample of an output voltage supplied by feedback elements 8. The output of the amplifier 4 is coupled to a control terminal 10 of a pass element 12 which serves to "pass" current from the unregulated input terminal 14 of the voltage regulator 2, to the regulated output terminal 16 of the voltage regulator 2. The feedback control loop 18 formed by the amplifier 4, pass element 12 and feedback elements 8 acts to force the control terminal 10 of the pass element 12 to a dynamic value that maintains a regulated voltage at the output terminal 16 of the voltage regulator 2.

The pass element 12 may be used in a common source/emitter configuration or a common drain/collector follower configuration. A voltage follower configuration has the advantages of not requiring a large output capacitance, having a better response time for transient signals, and providing greater immunity to output capacitor characteristics. Greater immunity to output capacitor characteristics is a significant advantage in low power LDO voltage regulators.

In either configuration, however, the pass element 12 functions as a "unipolar" element in conventional designs. A "unipolar" element, as used herein, is one which sources current to the load, but does not sink current from the load. In other words, a unipolar element can supply needed electrical charge to a load, but cannot remove excess electrical charge from the load. A load conventionally includes at least one large output capacitor 20. A linear voltage regulator 2 configured with a unipolar output stage, however, experiences two common problems: an output over-voltage or "hiccup," and instability at output current levels below a required minimum output current value.

First, when the load current required at the output terminal 16 of the voltage regulator 2 rapidly changes from a large value (e.g. near a maximum rated output) to a relatively small value (e.g. near zero), more current than is necessary may be supplied to the output terminal 16 until the feedback loop 18 regains control due a finite response time associated with the feedback control loop 18. The excess charge is stored on the output capacitor 20 and results in an output voltage higher than the desired regulation voltage. The increased voltage at the output terminal 16 causes the feedback control loop 18 to attempt to reduce the output voltage by reducing or stopping the current passing through the pass element 12. Even with the pass element 12 turned off, however, the output voltage remains high for a time because the feedback control loop 18 cannot remove the excess charge from the output capacitor 20. As a result, the feedback control loop locks-up, and the output terminal 16 remains in an over-voltage condition until the excess charge drains off of the output capacitor 20. This transient over-voltage is sometimes called a "hiccup."

In applications where the load current is small, this discharge process may take a relatively long time. Although the voltage regulator 2 includes a discharge path through the feedback elements 8, the amount of discharge through the feedback elements 8 is typically insignificant because the feedback elements 8 conventionally comprise large valued resistive elements. While the feedback control loop 18 is locked up and, therefore, unable to regulate, the voltage on the output capacitor 20 may be in a range that is harmful to the load circuitry and, therefore, have serious consequences.

The "hiccup" condition may also be further exacerbated when the excess charge is discharged from the output capacitor 20 and the voltage regulator 2 again begins to pass current through the pass element 12. As the feedback control loop 18 begins to respond to the need for more charge on the output, the pass element 12 is turned back "ON" to allow current to pass. This rapid change in current may result in another "hiccup" from the pass element 12 again passing too much current before the feedback control loop 18 has time to respond. With each subsequent "hiccup," the feedback control loop 18 locks up and takes time to recover during which it cannot properly regulate the output voltage. Each subsequent "hiccup" decreases in magnitude until the feedback control loop 18 no longer locks up. In other words, the feedback control loop 18 oscillates between locking-up and being in control of the pass element 12 for a time following an initial "hiccup."

Second, the stability problem occurs under low or no-load conditions where the only current passing through the pass element 12 is due to the current passing to ground through the feedback elements 8. As stated previously, because the feedback elements 8 conventionally include large valued resistive elements, this current is very small compared to a current for a load at the output terminal 16, and is typically below the minimum output current requirements of the pass element 12. This small current in the relatively large pass element 12 causes low transconductance ($g_m$) due to low current density therein, decreases loop gain and increases output impedance, potentially causing an unstable condition. An unstable condition results from the voltage regulator failing to regulate the output voltage which may cause the output voltage to oscillate undesirably until the specified minimum output current again flows through the pass element 12. This problem is more pronounced with pass elements 12 implemented as "followers" configured as a common drain or a common collector amplifier.

Early linear voltage regulators used a pass clement 12 which was an NPN transistor in an emitter follower configuration. These early voltage regulators did not require LDO characteristics, and conventionally did not have load currents which rapidly transitioned between high and low values during periods where tight output voltage regulation was required. Thus, the above described "hiccup" and minimum current problems were not significant. However, as dropout became more important (i.e. with battery powered systems), LDO voltage regulators 22 were introduced which used the pass element 24 in the common emitter and, later, common source configurations (FIG. 2). FIG. 2 illustrates a conventional LDO voltage regulator 2 implementation of the circuit shown in FIG. 1. For the LDO voltage regulator 22, the reference voltage 26 (which may be provided by a bandgap reference or any other voltage reference generator known in the art) is applied to the inverting terminal 28 of the error amplifier 30. The error amplifier 30 compares the voltage reference 26 at the inverting terminal 28 to the output voltage sample provided by the feedback network 32, and controls the gate/base of a PMOS/PNP pass element 24 coupled between the input 34 and output 36 terminals of the voltage regulator 22.

As battery powered or power managed applications became more prevalent in the market, loads that switch from full current to zero or nearly zero current became more common and the hiccup problem became more of a concern. A first example of an approach to addressing the hiccup problem is described in U.S. Pat. No. 5,864,227 to Borden et al. (Jan. 26, 1999), an embodiment of which is shown in FIG. 3. In addition to the conventional elements used in prior art voltage regulator circuits, the Borden et al. approach uses a voltage regulator 38 having a "pull-down" circuit 40 comprising a secondary reference voltage 42, a comparator 44, and a pull-down transistor 46. When the comparator 44 senses that the voltage at the control terminal 48 of the pass element 50 is approximately equal to that of the secondary reference voltage 42, it turns the pull-down transistor 46 "ON" to draw current from the output capacitor 52 until the feedback control loop recovers. The Borden et al. approach may be used for LDO regulators using a pass element 50 configured in the common source or common emitter configurations.

The voltage regulator shown in FIG. 3, however, utilizes a more digital than linear approach to controlling the voltage at the output terminal 51. In an over-voltage or hiccup condition, a low impedance or a current source "load" is introduced through the pull-down transistor 46 until the over-voltage is discharged. This approach requires the feedback loop to be out of control before it can function, and, therefore, has an attendant response and recovery period for each lock-up condition. Furthermore, the voltage regulator circuit 38 of FIG. 3 requires at least one additional comparator 44 to implement, and, therefore, uses more chip area, and still fails to address the problem of instability at the minimum output current. Additionally, for the voltage regulator 38 of FIG. 3, the pass element 50 must be configured as a common source or common collector amplifier and, thus, cannot achieve the advantages of a voltage follower configuration.

A second non-prior art example of an approach to addressing the hiccup problem is fully described in the commonly assigned co-pending patent application entitled OVERVOLTAGE SENSING AND CORRECTION CIRCUITRY AND METHOD FOR LOW DROPOUT VOLTAGE REGULATOR by Tony Larson and David Heisley, U.S. patent application Ser. No. 09/560376 to Larson et al. (filed Apr. 28, 2000). An embodiment of the Larson et al. approach is shown in FIG. 4. The Larson et al. approach to resolving the hiccup problem, like the Borden et al. approach, uses a voltage regulator 56 having a pull-down circuit 58. Unlike the Borden et al. approach, however, the Larson et al. approach does not require a secondary reference voltage. The Larson et al. approach uses the primary reference voltage 60 as a reference for determining when the comparator 62 will turn the pull-down transistor 64 "ON" and "OFF." Thus, when the inputs to the error amplifier 66 are such that the pass element 68 is turned "ON," the oppositely configured inputs to the comparator 62 will be such that the pull-down transistor is turned "OFF." Conversely, when the inputs to the error amplifier 66 are such that the pass element 68 is turned "OFF," the oppositely configured inputs to the comparator 62 will be such that the pull-down transistor is turned "ON" to sink the excess charge on the output capacitor 70 until the voltage at the output terminal 72 is within regulation. The Larson et al. approach may be used for LDO regulators using a pass element 68 configured in either the common source or common drain configurations.

Similar to the Borden et al. approach, however, the Larson et al. approach implements a comparator 62 to initiate a low impedance load under over-voltage conditions until the over-voltage is discharged and is, thus, locked-up during over-voltage periods. Also similar to the Borden et al. approach, the Larson et al. approach requires at least one additional comparator 62 to implement.

A third example of an approach to addressing the hiccup problem is described in U.S. Pat. No. 5,608,312 to Wallace (Mar. 4, 1997), an embodiment of which is shown in FIG. 5. The Wallace approach uses a pair of differential amplifiers 74 and 76 to control a pair of common source pass elements 78 and 80 in a push-pull configuration. The inverting inputs 82 and 84 are coupled to a reference voltage 86, and the non-inverting inputs 88 and 90 are connected to an output node 94. When the first pass device 78 is turned "OFF," the second pass device 80 is turned "ON" to pass excess charge from the output capacitor 92 to ground. The Wallace approach is appropriate for use in SCSI terminator regulators that utilize complementary pass elements 78 and 80 in the common source or common emitter configurations.

The voltage regulator circuit shown in FIG. 5, however, cannot achieve the advantages of a voltage follower configuration because the pass elements 78 and 80 must be configured as common source or common emitter amplifiers. Furthermore, although the voltage regulator circuit of FIG. 5 can help stability under low load or no load conditions, because at least one pass element is on during both source and sink, it has difficulty controlling the bias current in each of the pass elements.

Therefore, it is desirable to have a voltage regulator which avoids the over-voltage or hiccup problem in addition to overcoming the problem of instability at low output currents.

SUMMARY OF THE INVENTION

It is an object of the invention to provide smaller and less expensive voltage regulators than those known in the prior art.

It is an object of the invention to provide a voltage regulator which can both source charge to and sink charge from the regulated voltage output to overcome the over-voltage or "hiccup" problem.

It is an object of the invention to provide a voltage regulator which overcomes the problem of instability at low output currents.

The present invention provides a simple approach to resolving the over-voltage and low output current instability problems involving an LDO voltage regulator utilizing a follower pass element which can source and sink charge from a regulated output voltage conductor, which does not require the bulky comparators of prior art approaches, and which maintains low output impedance during the transition from source to sink operations. According to an embodiment of the invention, an LDO voltage regulator output stage comprises a first pass device controlled by a first control signal and coupled between an unregulated input voltage conductor and a regulated output voltage conductor. The voltage regulator also includes a second pass device coupled between the regulated output voltage conductor and ground, and controlled by a second control signal. The first and second pass devices are coupled in a complementary voltage follower configuration. The control signals operate in response to the difference between a reference voltage and the voltage on the regulated output voltage conductor to source current to the regulated output voltage conductor through the first pass device and/or sink current from the regulated output voltage conductor through the second pass device to ground.

According to a specific embodiment of the invention, the control signal for both the first and second pass devices is an output of an error amplifier referencing a voltage reference and a feedback signal. According to another specific embodiment of the invention, the control signal for the first pass device is the output of the error amplifier and the control signal for the second pass device is the output of the error amplifier offset by a bias voltage. By offsetting the control signal for the second pass device from that of the first pass device, both the first and second pass devices remain "ON" at the same time for a portion of the transition between sourcing and sinking current to the voltage regulator output. By maintaining both of the pass devices "ON" at the same time, the voltage regulator maintains low output impedance and the control loop does not lock up during the transition. Further more, a bias current may be provided through the second pass device under low output current situations to keep the output stage transconductance ($g_m$) high and, thus, maintain low output impedance.

Other embodiments of the present invention involve various methods of producing control signals for the second pass device to increase control over the output voltage levels while avoiding the over-voltage and low output current problems previously experienced.

BRIEF DESCRIPTION OF THE SEVERAL VIEWS OF THE DRAWINGS

The nature of the present invention as well as other embodiments of the present invention may be more clearly understood by reference to the following detailed description of the invention, to the appended claims, and to the drawings herein, wherein:

DETAILED DESCRIPTION OF THE INVENTION

Figure 1:
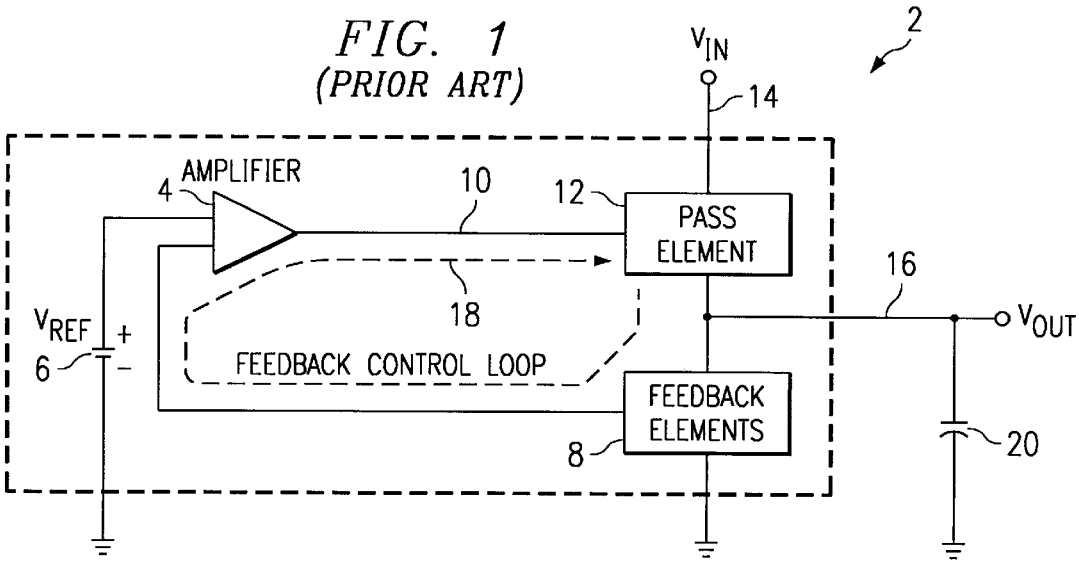
FIG. 1 (PRIOR ART)
FIG. 1 is a generalized block diagram of a prior art voltage regulator.
Figure 2:
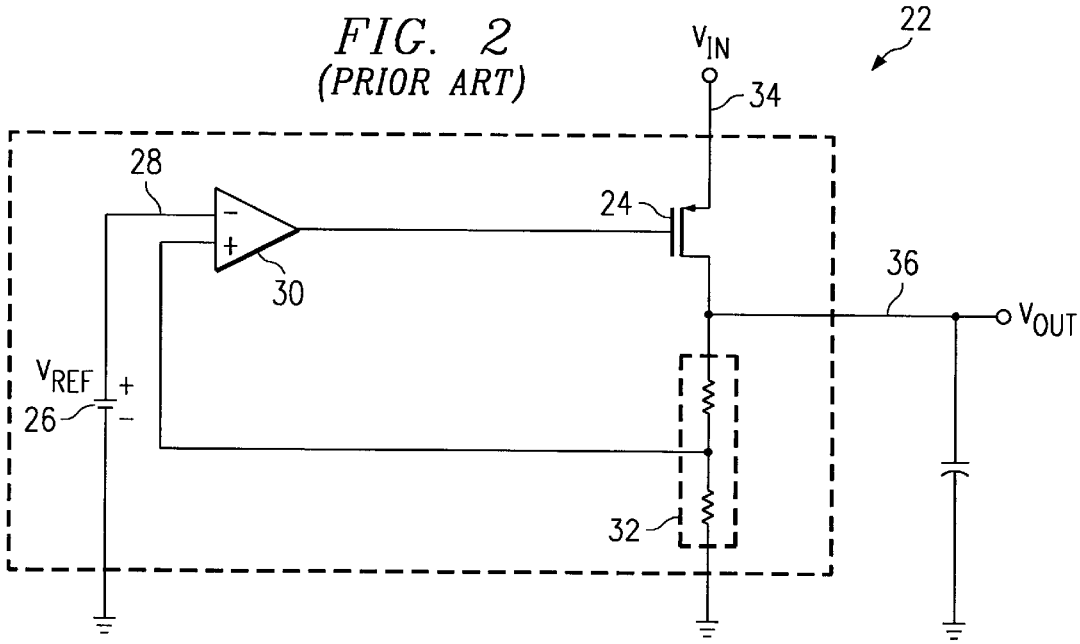
FIG. 2 (PRIOR ART)
FIG. 2 is a schematic diagram of another prior art voltage regulator.
Figure 3:
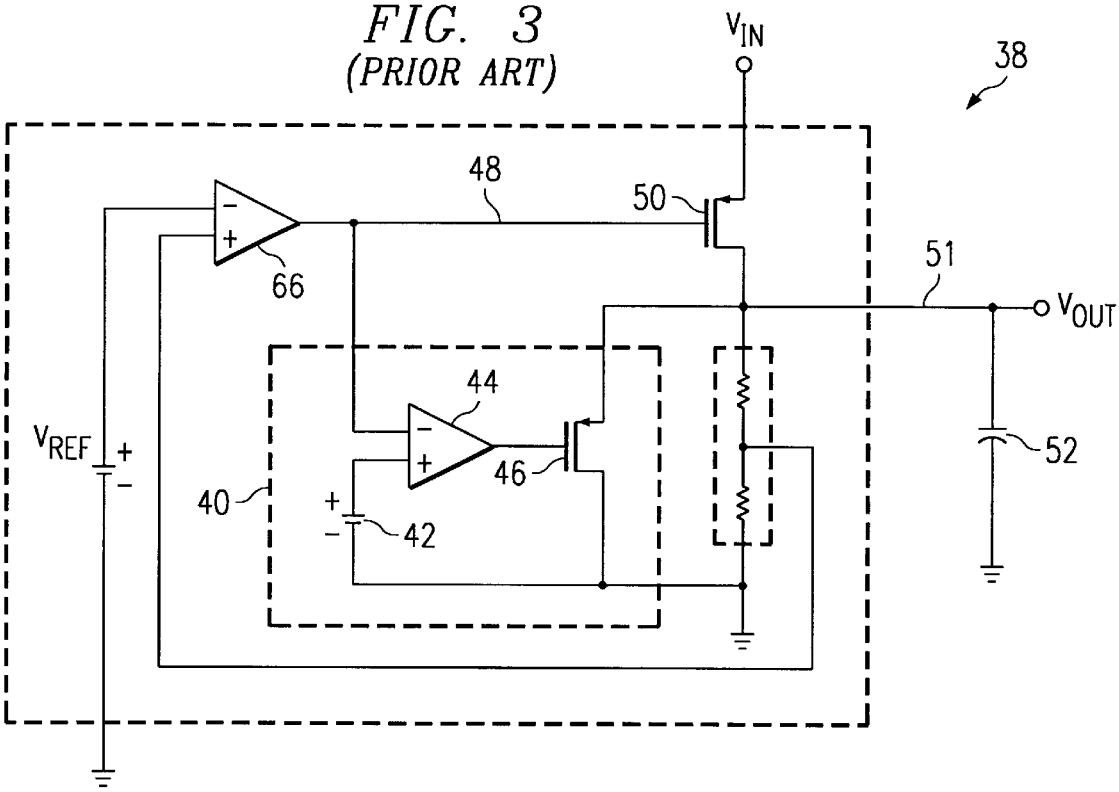
FIG. 3 (PRIOR ART)
FIG. 3 is a schematic diagram of another prior art voltage regulator.
Figure 4:
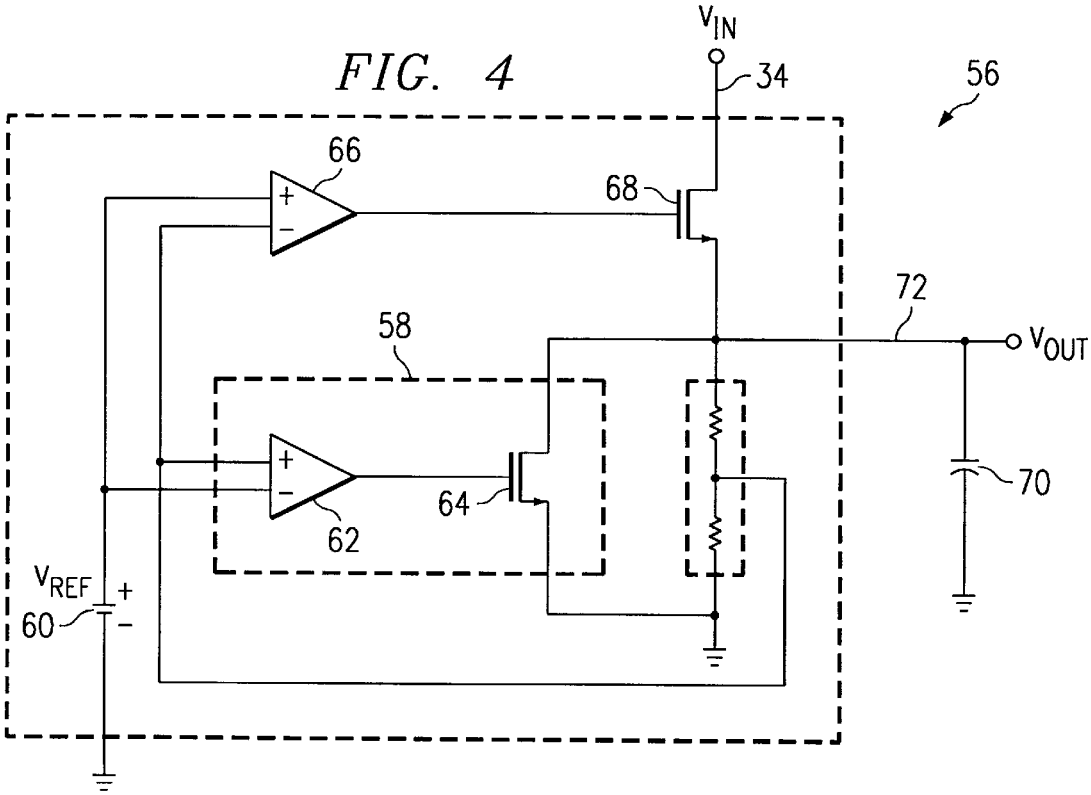
FIG. 4 is a schematic diagram of a voltage regulator which provides useful background in understanding the present invention.
Figure 5:
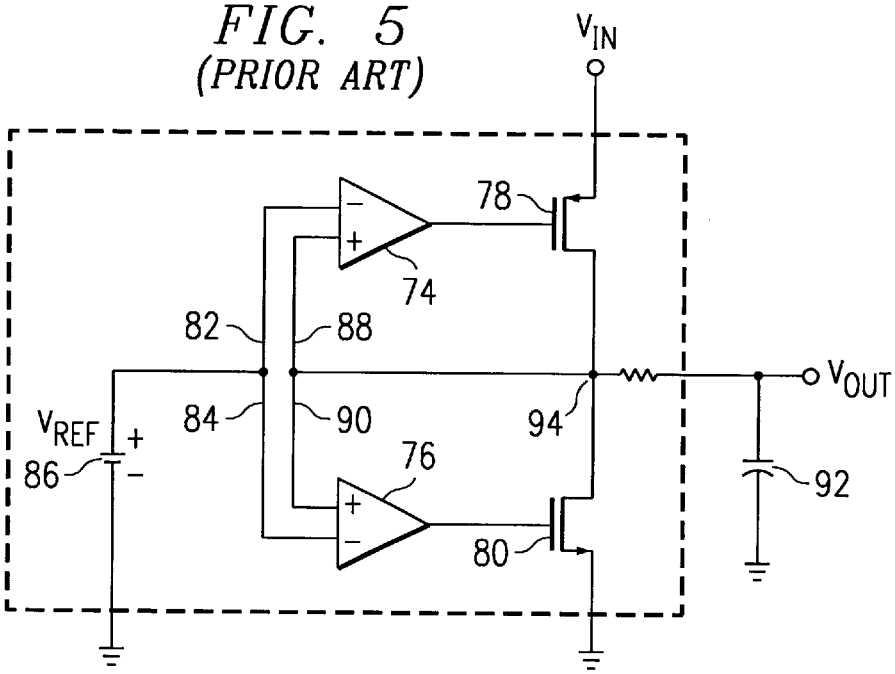
FIG. 5 (PRIOR ART)
FIG. 5 is schematic diagram of another prior art voltage regulator.
Figure 6:
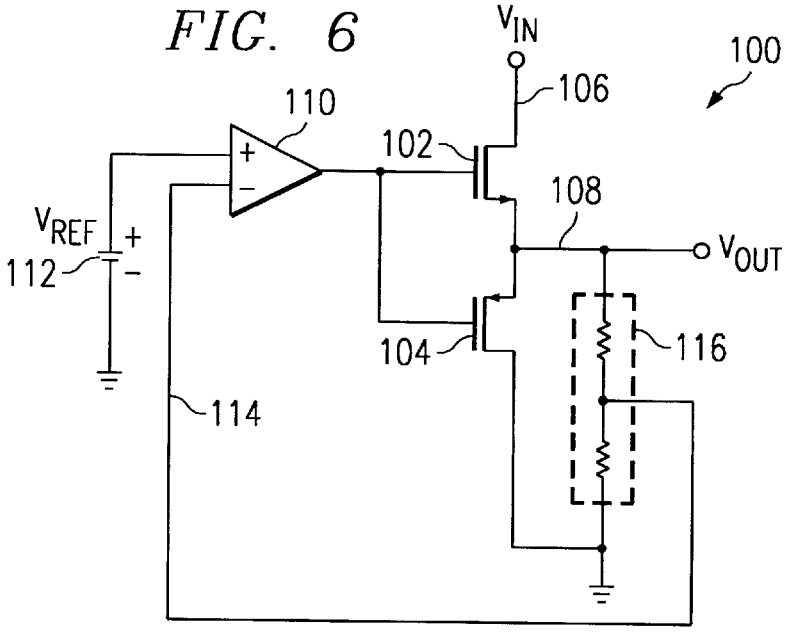
FIG. 6 is a schematic diagram of a voltage regulator according to a first embodiment of the present invention.

In reference to FIG. 6, an LDO voltage regulator 100 includes a pass device, such as NMOS pass transistor 102, and an over-voltage pass device 104, such as PMOS discharge transistor 104, coupled in a complementary voltage follower configuration. Specifically, the pass transistor 102 includes a drain coupled to an unregulated input voltage conductor 106, a source coupled to a regulated output voltage conductor 108, and a gate coupled to an output of an error amplifier 110. The discharge transistor 104 also includes a source coupled to the regulated output voltage conductor 108, a drain coupled to ground, and a gate coupled to the output of the error amplifier 110. The error amplifier 110 includes a non-inverting input coupled to a voltage reference $V_{REF}$ 112 which is also coupled to ground. The inverting input of the error amplifier 110 is coupled to a feedback conductor 114. Feedback network 116 is coupled between the regulated voltage conductor 108 and ground and comprises two resistors coupled in series. The feedback conductor 114 is connected to the feedback network 116 at a junction between the two resistors.

Coupling the sources of both the pass transistor 102 and the discharge transistor 104 to the regulated output voltage conductor 108 creates a simple output stage with "bipolar" action. Distinct from conventional follower configurations with only unipolar pass elements, the bipolar configuration 1 of the present invention enables the voltage regulator 100 to sink current from a load coupled to the regulated output voltage conductor 108 as well as source current to it. It should be noted, however, that although the output devices are complementary, there is no requirement for them to be of similar size or current carrying capacity. In practice, the pass transistor 102 generally has a much larger channel W/L ratio and/or has a much greater current handling capacity than the discharge transistor 104. The same error amplifier 110 may be used to control both the pass transistor 102 and the discharge transistor 104 and no additional comparators or reference voltages are required to practice the invention.

The embodiment shown in FIG. 6, while effective to avoid the hiccup condition, may still have instability problems at low output current levels. The instability is caused at the transition between the pass transistor 102 being "ON" and the discharge transistor 104 being "ON." During this transition, both the pass transistor 102 and the discharge transistor 104 are simultaneously "OFF" for a time, leaving the control loop open. With the control loop open, the voltage regulator is not regulating and, thus, has no control over the output voltage.

Figure 7:
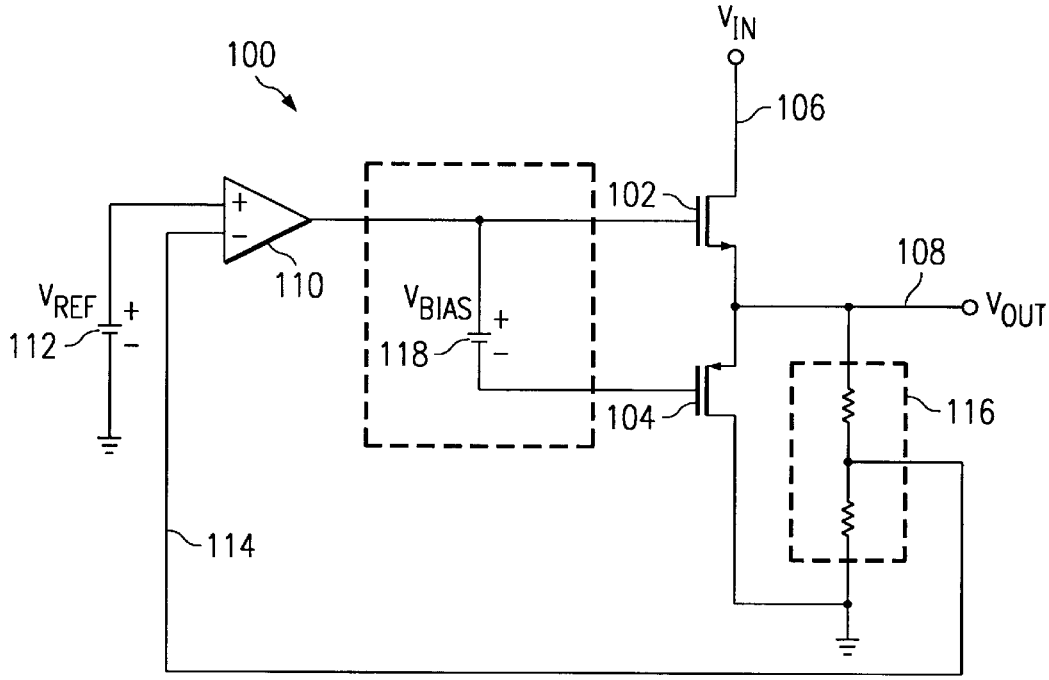
FIG. 7 is a schematic diagram of a voltage regulator according to a second embodiment of the present invention.

As shown in FIG. 7, though not required, it is preferable to separate the gates of the pass transistor 102 and the discharge transistor 104 by a bias voltage source 118 producing a bias voltage $V_{BIAS}$. By establishing a bias voltage $V_{BIAS}$, between the gates of the pass devices 102 and 104, both the pass transistor 102 and the discharge transistor 104 are simultaneously "ON" for a time during the transition between output current source and sink operations. This also results in one or both of the pass and discharge transistors 102 and 104 being "ON" when the load current is zero, thus, keeping the feedback loop closed and the output impedance low. Without the bias voltage $V_{BIAS}$, the transfer characteristic of the voltage regulator output stage includes a dead band wherein both the pass transistor 102 and the discharge transistor 104 are "OFF" for a time during the transition from a source operation to a sink operation. Including the bias voltage $V_{BIAS}$ allows the output stage to operate in a continuous, linear mode as the current requirement changes from source to sink.

Figure 8:
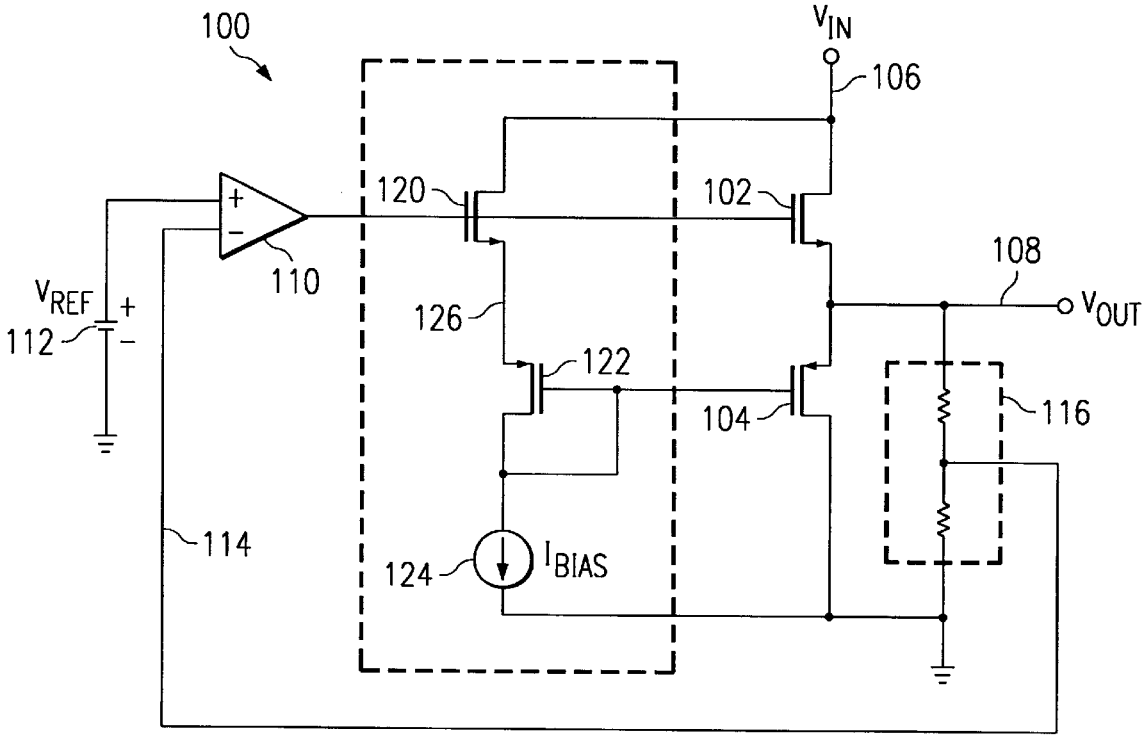
FIG. 8 is a schematic diagram of a voltage regulator according to a third embodiment of the present invention.

In FIG. 8, the bias voltage source 118 has been replaced with first and second bias devices 120 and 122, such as NMOS transistor 120 and PMOS transistor 122, and a bias current source 124 producing a bias current $I_{BIAS}$. The first bias transistor 120 includes a drain coupled to the unregulated input voltage conductor 106, a gate coupled to the output of the error amplifier 110 and a source coupled to a bias conductor 126. The second bias transistor 122 includes a source coupled to the bias conductor 126, a gate coupled to the gate of the discharge transistor 104, and a drain coupled to the gate of the second bias transistor 122. The bias current source 124 is coupled between the drain of the second bias transistor 122 and ground.

The first bias transistor 120 is preferably a scaled replica of the pass transistor 102, and the second bias transistor 122 is preferably a scaled replica of the discharge transistor 104. As used herein, the term "scaled replica" means having the same device characteristics (i.e. threshold voltage, etc.) but a different W/L ratio or emitter area. The bias current source 124 ($I_{BIAS}$) establishes the voltage ($V_{GS}$) between the gate and source for both the first and second bias transistors 120 and 122, thereby establishing a fixed and/or controllable bias voltage between the gates of the pass and discharge transistors 102 and 104. Though not required, it is desirable to use bias devices 120 and 122 having characteristics similar to those of the pass devices 102 and 104 to get a well controlled operating bias. For example, if the first bias transistor 120 has the same structure and threshold voltage as the pass transistor 102, and the second bias transistor 122 has the same structure and threshold as the discharge transistor 104, the bias current in the pass devices 102 and 104 can be precisely controlled by the bias current source 124.

One function of a voltage regulator is to limit the output current to a value that will not harm the voltage regulator or the load circuitry. A voltage regulator accomplishes this by sensing the output current and clamping it at some maximum value. Because a regulator is a power device, and because a low voltage drop across the voltage regulator is advantageous, it is desirable to avoid series sense elements that add voltage drop and power dissipation. Therefore, circuits which utilize parallel sense elements are more desirable than those which utilize series sense elements. Furthermore, because a current limiting device is required by a voltage regulator anyway, by implementing the current limiting device according to embodiments of the present invention, the output stage current sink is implemented in parallel using only minimal additional elements and resulting in minimal additional power dissipation.

Another advantage of the embodiments of the present invention is the small footprint size of the required devices and the relatively small number of required elements. Both the bias current source 124 and the second bias transistor 122 may be fabricated as minimum or near-minimum footprint size devices, and the discharge transistor needs only be large enough to handle the current generated during an over-voltage correction. Therefore, the embodiments disclosed herein are particularly advantageous in that they overcome both the hiccup and instability problems discussed previously without the size and space requirements of the prior art embodiments. By example, in one specific implementation of the present invention, the first bias transistor 120 is 1/1000th the size of the pass transistor 102, and the second bias transistor 122 is 1/16th the size of the discharge transistor.

Figure 9:
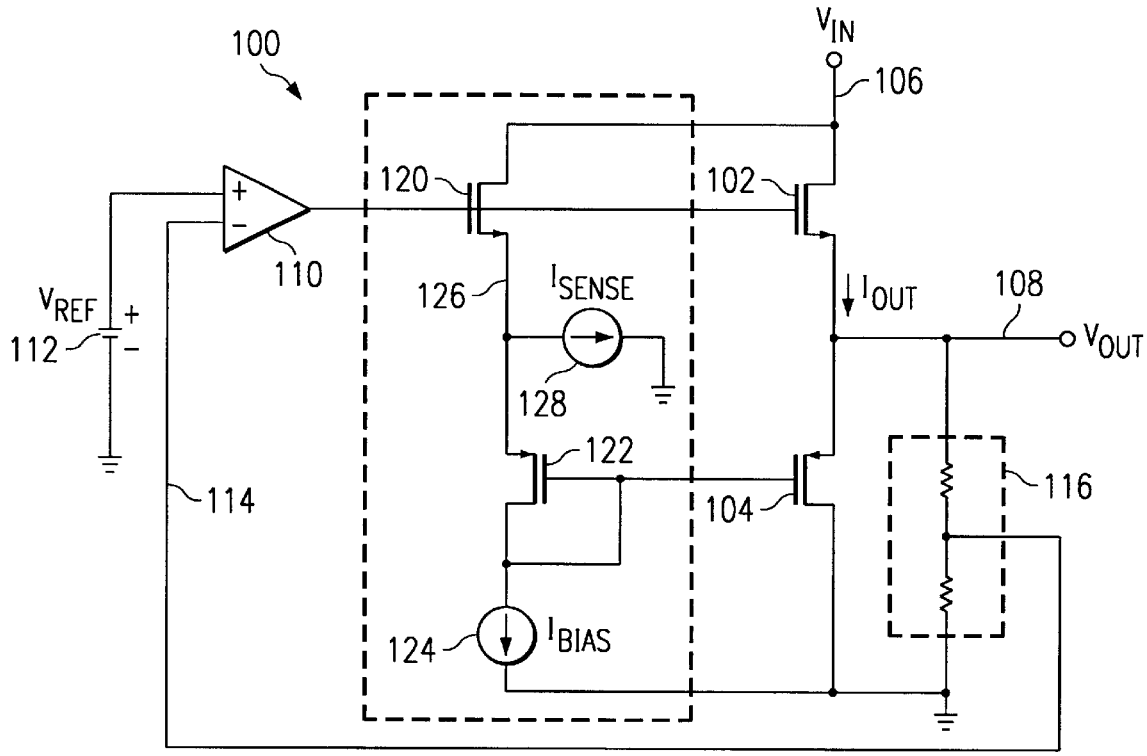
FIG. 9 is a schematic diagram of a voltage regulator according to a fourth embodiment of the present invention.

In FIG. 9, a variable current source 128 producing a variable current $I_{SENSE}$ is added to the voltage regulator circuit 100 shown in FIG. 8. The current source 128 is coupled between the bias conductor 126 and ground such that it draws current from the source of the first bias transistor 120. If the sum of the current $I_{SENSE}$ and the bias current $I_{BIAS}$ ($I_{SENSE}+I_{BIAS}$) is varied to be proportional to the output current $I_{OUT}$ such that the current densities in each of the pass transistor 102 and the first bias transistor 120 are equal, then the voltage at the source of the first bias transistor 120 will be the same as the voltage at the source of the pass transistor 102.

Under these conditions, the bias current $I_{BIAS}$ establishes a voltage ($V_{GS}$) between the gate and source of the second bias transistor 122 that is mirrored between the gate and source of the discharge transistor 104. Having the mirrored voltage ($V_{GS}$) between the gate and source of the discharge transistor 104 causes a bias current to flow through the discharge transistor 104 which is a scaled version of the bias current source $I_{BIAS}$ 124. Therefore, by implementing the current source 128 between the bias conductor 126 and ground, a fixed and well controlled bias current through the second bias transistor 122 may be established while the regulator is supplying load current (sourcing current) to the regulated output voltage conductor 108.

Specifically, when the output current $I_{OUT}$ is very large, the variable current $I_{SENSE}$ has a value equal to the ratio of the first bias transistor 120 channel W/L ratio divided by the pass transistor 102 channel W/L ratio multiplied by the output current $I_{OUT}$. Thus, if the bias transistor 120 channel W/L ratio is 1/1000th the value of the pass transistor 102 channel W/L ratio, $I_{SENSE}=I_{OUT}/1000$. Under this condition, the discharge transistor 104 has turned "ON" only slightly and is passing a current equal to the value of $I_{BIAS}$ multiplied by the ratio of the discharge transistor 104 channel W/L ratio divided by the second bias transistor 122 channel W/L ratio. Thus, if the second bias transistor 122 channel W/L ratio is 1/16th the value of the discharge transistor 104 channel W/L ratio, the current passing through the discharge transistor 104 under this condition is $I_{BIAS}*16$. If the pass transistor 102 is "OFF," however, a current much larger than $I_{BIAS}*16$ will pass through the discharge transistor 104 to ground because the gate-to-source voltage of the discharge transistor will be equal to the gate-to source voltage of the first bias transistor 120 plus the gate-to-source voltage of the second bias transistor 122 ($V_{gs104}=V_{gs120}+V_{gs122}$).

Figure 10:
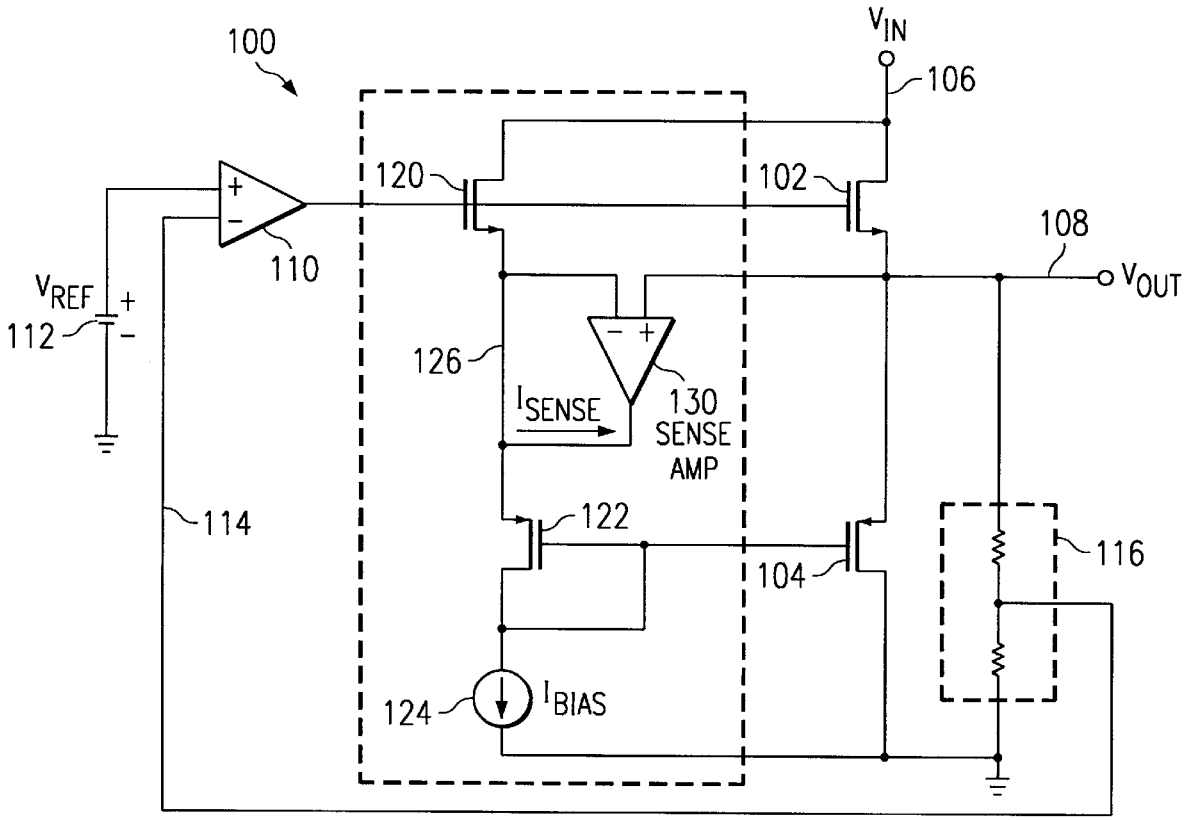
FIG. 10 is a schematic diagram of a voltage regulator according to a fifth embodiment of the present invention.

FIG. 10 illustrates an embodiment of the present invention which substitutes specific elements for the current source 128 shown in FIG. 9. In FIG. 10, a sense amplifier 130 is connected as a unity gain follower with the inverting input and the output both coupled to the bias conductor 126 and the non-inverting input coupled to the regulated output voltage conductor 108. By coupling the sense amplifier 130 in this configuration, the voltage on the bias conductor 126 is forced to $V_{OUT}$. If both the pass transistor 102 and the first bias transistor 120 have similar threshold voltages (Vt), the current that flows into the output of the sense amplifier 130 will be proportional to the load current.

Figure 11:
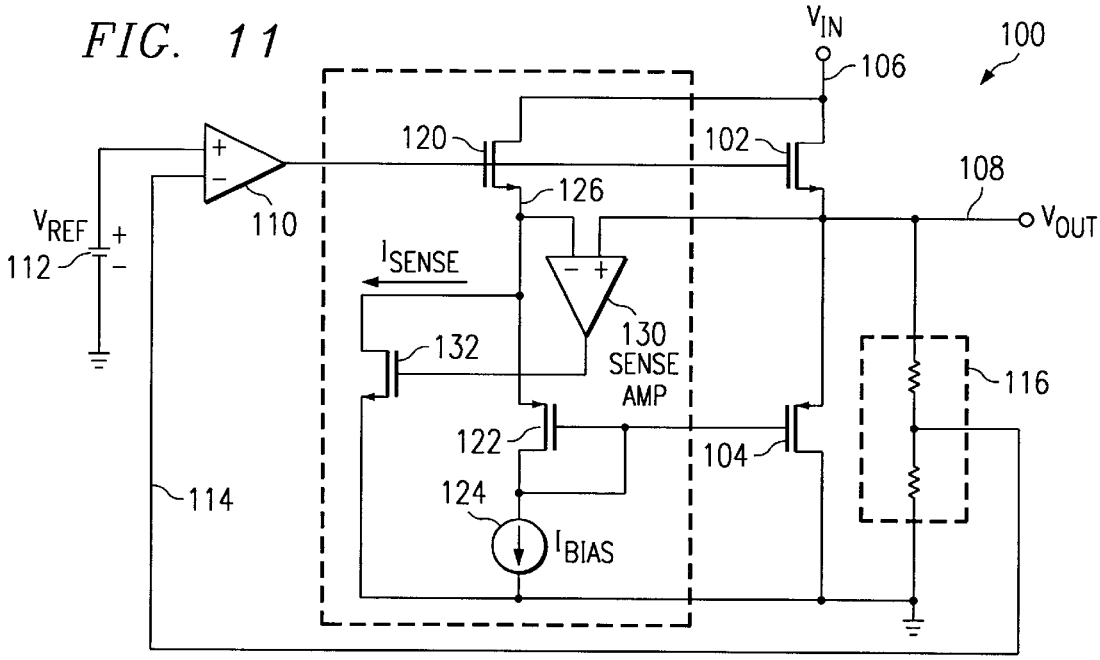
FIG. 11 is a schematic diagram of a voltage regulator according to a sixth embodiment of the present invention.

FIG. 11 includes another embodiment of the invention, similar to FIG. 10, which illustrates another implementation of the current source 128 and the bias current source 124 shown in FIG. 9. In place of the current source 128 of the embodiment of FIG. 9, the embodiment shown in FIG. 11 implements a sense amplifier 130 with the inverting input coupled to the bias conductor 126, the non-inverting input coupled to the regulated output voltage conductor 108, and the output coupled to the gate of a sense transistor 132 (NMOS). The sense transistor 132 further includes a drain coupled to the bias conductor 126 and a source coupled to ground. As with the embodiment shown in FIG. 10, this configuration forces the voltage on the bias conductor 126 toward the output voltage $V_{OUT}$ and varies the source current $I_{SENSE}$ proportionally with the load current if both the pass transistor 102 and the first bias transistor 120 have similar threshold voltages (Vt).

Figure 12:
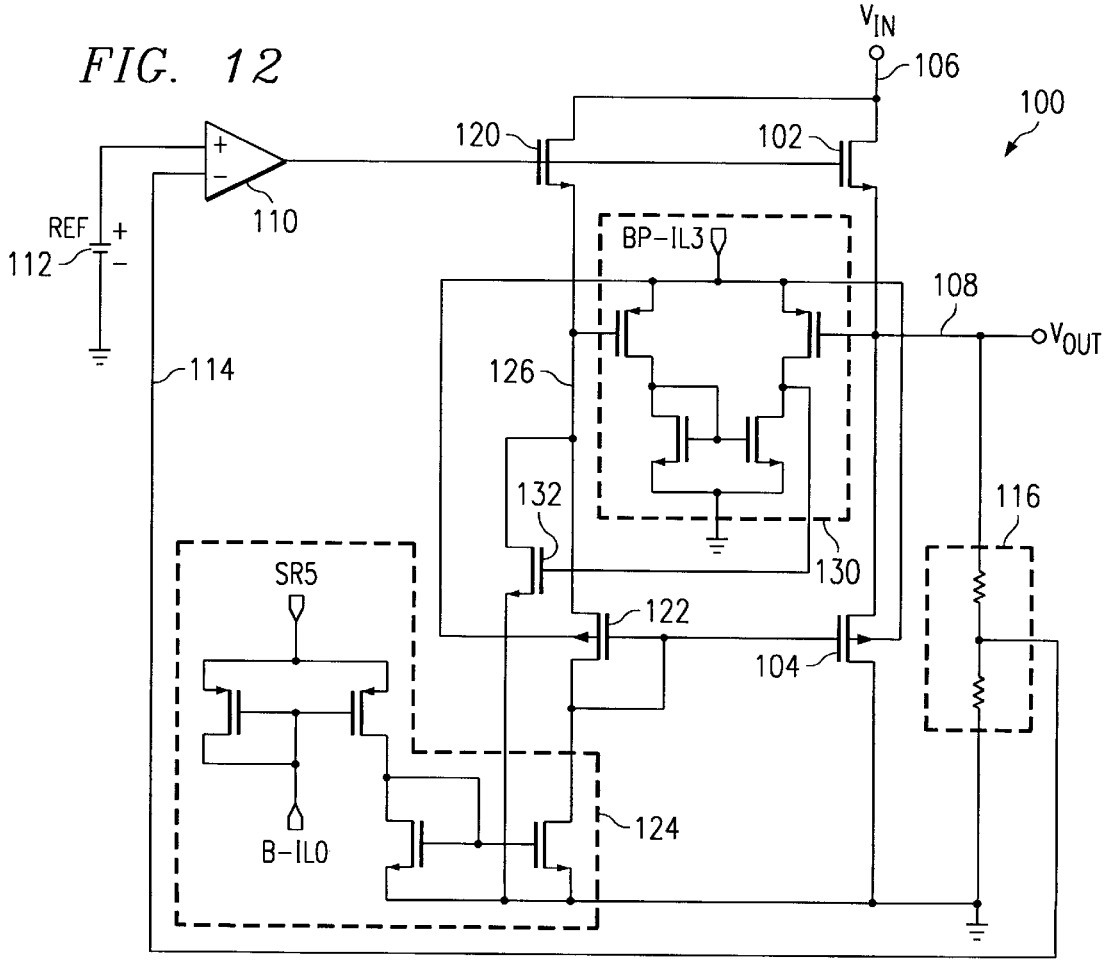
FIG. 12 is a schematic diagram of a voltage regulator according to a seventh embodiment of the present invention.

FIG. 12 includes a schematic diagram of one specific embodiment of the circuit shown in FIG. 11. The diagram included in FIG. 12 shows one possible implementation of the sense amplifier 130 and the bias current 124 ($I_{BIAS}$) shown and described with respect to FIG. 11.

Although the present invention has been shown and described with reference to particular preferred embodiments, various additions, deletions and modifications that are obvious to a person skilled in the art to which the invention pertains, even if not shown or specifically described herein, are deemed to lie within the scope of the invention as encompassed by the following claims. For example, although the specific embodiments of the present invention shown herein use NMOS and PMOS transistor implementations, it will be understood by one of ordinary skill in the art that depending upon the specific application in which the invention is used, other devices (i.e. PNP, NPN, DMOS, and the like) may readily be exchanged for the specific transistors shown. For example, in different implementations, the opposite transistor type (i.e., bipolar or MOS), the opposite conductivity type (i.e., PNP or NPN), or opposite channel type (i.e., N-channel or P-channel) to that disclosed above may be used.

What is claimed is:

1. A voltage regulator comprising:

an error amplifier having a first input coupled to a first reference voltage, a second input, and an output configured to produce a first control signal;

a pass transistor having a drain coupled to an unregulated input voltage conductor, a source coupled to a regulated output voltage conductor, and a gate configured to receive the first control signal;

a discharge transistor having a source coupled to the regulated output voltage conductor, a drain coupled to a second reference voltage, and a gate configured to receive a second control signal; and a feedback circuit coupled between the regulated output voltage conductor and the second input of the error amplifier.

2. The voltage regulator of claim 1, further comprising a biasing circuit coupled between the gate of the discharge transistor and the output of the error amplifier.

3. The voltage regulator of claim 2, the biasing circuit comprising a bias voltage source.

4. The voltage regulator of claim 2, the biasing circuit comprising:

a first bias transistor having a source, a drain coupled to the unregulated input voltage conductor, and a gate configured to receive the first control signal;

a second bias transistor having a drain, a source coupled to the source of the first bias transistor, and a gate coupled to the gate of the discharge transistor and to the drain of the second bias transistor; and a bias current source coupled between the drain of the second bias transistor and to the second reference voltage.

5. The voltage regulator of claim 4, wherein the first bias transistor is a sealed replica of the pass transistor, the second bias transistor is a scaled replica of the discharge transistor and the bias current source is configured to establish at least one of a fixed voltage and a controllable bias voltage between the gates of the pass transistor and the discharge transistor.

6. The voltage regulator of claim 4, the biasing circuit further comprising a sense current source coupled to the source of the first bias transistor and configured to generate a scaled copy of a current flow through the pass transistor.

7. The voltage regulator of claim 6, wherein the sense current source comprises a sense amplifier having a first input coupled to the regulated output voltage conductor, a second input coupled to the source of the first bias transistor, and an output coupled to the second input of the sense amplifier.

8. The voltage regulator of claim 2, wherein the biasing circuit comprises:

a first bias transistor having a drain coupled to the unregulated input voltage conductor, a source, and a gate configured to receive the first control signal;

a second bias transistor having a source coupled to the source of the first bias transistor, a drain, and a gate coupled to the gate of the discharge transistor and to the drain of the second bias transistor;

a sense amplifier having a first input coupled to the regulated output voltage conductor, a second input coupled to the source of the first bias transistor, and an output; and a sense transistor having a drain coupled to the source of the first bias transistor, a source coupled to the second reference voltage, and a gate coupled to the output of the sense amplifier.

9. The voltage regulator of claim 2, the biasing circuit comprising:

a bias transistor having a gate coupled to the gate of the discharge transistor and to a drain of the bias transistor; and a bias current source coupled between the drain of the bias transistor and to the second reference voltage.

10. A voltage regulator comprising:

a first pass device coupled between an unregulated input voltage conductor and a regulated output voltage conductor, the first pass device configured to respond to a first control signal; and a second pass device coupled between the regulated output voltage conductor and a reference voltage, the second pass device configured to respond to a second control signal; wherein the first and second pass devices are coupled in a complementary voltage follower configuration.

11. The voltage regulator of claim 10, wherein the first pass device is an NMOS transistor having a drain coupled to the unregulated input voltage conductor and a source coupled to the regulated output voltage conductor, and the second pass device is a PMOS transistor having a source coupled to the regulated output voltage conductor and a drain coupled to ground.

12. The voltage regulator of claim 11, wherein both the NMOS and PMOS pass transistors having gates coupled to the output of an error amplifier generating the first and second control signals.

13. The voltage regulator of claim 11, further comprising a biasing circuit coupled between a gate of the NMOS pass transistor and a gate of the PMOS pass transistor, wherein the gate of the NMOS pass transistor is further coupled to an output of an error amplifier generating the first control signal.

14. The voltage regulator of claim 13, wherein the biasing circuit comprises:

a PMOS bias transistor having a gate coupled to the gate of the PMOS pass transistor and to a drain of the PMOS bias transistor; and a bias current source coupled between the drain of the PMOS bias transistor and to the second reference voltage.

15. The voltage regulator of claim 14, the biasing circuit further comprising an NMOS bias transistor having a drain coupled to the unregulated input voltage conductor, a source coupled to a source of the PMOS bias transistor, and a gate configured to receive the first control signal.

16. The voltage regulator of claim 15, wherein the PMOS bias transistor is a scaled replica of the PMOS pass transistor, the NMOS bias transistor is a scaled replica of the NMOS pass transistor, and the bias current source is configured to establish at least one of a fixed voltage and a controllable bias voltage between the gate of the PMOS bias transistor and the gate of the PMOS pass transistor.

17. The voltage regulator of claim 16, the biasing circuit further comprising a sense current source coupled to the source of the NMOS bias transistor and configured to generate a scaled copy of the current flow through the NMOS pass transistor.

18. The voltage regulator of claim 17, wherein the sense current source comprises a sense amplifier having a first input coupled to the regulated output voltage conductor, a second input coupled to the source of the PMOS bias transistor, and an output coupled to the second input of the sense amplifier.

19. The voltage regulator of claim 13, wherein the biasing circuit comprises:

a first NMOS bias transistor having a drain coupled to the unregulated input voltage conductor, a source, and a gate configured to receive the first control signal;

a PMOS bias transistor having a source coupled to the source of the first NMOS bias transistor, a drain, and a gate coupled to the gate of the discharge transistor and to the drain of the PMOS bias transistor;

a sense amplifier having a first input coupled to the regulated output voltage conductor, a second input coupled to the source of the first NMOS bias transistor, and an output; and a second NMOS bias transistor having a drain coupled to the source of the first NMOS bias transistor, a source coupled to ground, and a gate coupled to the output of the sense amplifier.

20. The voltage regulator of claim 10, wherein the first and second control signals are generated in response to a voltage difference between a fixed reference voltage and a voltage on a feedback conductor to control the current flow through each of the first and second pass devices, respectively, to source current to the regulated output voltage conductor from the unregulated input voltage conductor, and to sink current from the regulated output voltage conductor to ground.

21. A method of regulating voltage, the method comprising:

providing an input voltage to be regulated on an input conductor;

generating an output voltage on an output conductor;

generating a first control signal in response to a voltage difference between a sample of the output voltage and a reference voltage;

passing current from the input conductor to the output conductor in response to the first control signal;

passing current from the output conductor to ground in response to a second control voltage; and simultaneously passing charge from the input conductor to the output conductor and passing charge from the output conductor to ground for a portion of a transition between providing charge to the output conductor and removing charge from the output conductor.

22. The method of claim 21, further comprising generating the second control signal by establishing a controllable bias voltage between the first control signal and the second control signal.

23. The method of claim 21, wherein passing charge from the input conductor to the output conductor comprises passing charge through an MOS transistor having a gate configured to receive the first control signal, and wherein passing charge from the output conductor to ground comprises passing charge through an MOS transistor having a gate configured to receive the second control signal.

24. A voltage regulator comprising:

an error amplifier having a first input coupled to a first reference voltage, a second input, and an output configured to produce a first control signal; a pass transistor having a drain coupled to an unregulated input voltage conductor, a source coupled to a regulated output voltage conductor, and a gate configured to receive the first control signal;

a discharge transistor having a source coupled to the regulated output voltage conductor, a drain coupled to a second reference voltage, and a gate configured to receive a second control signal; and a single feedback circuit coupled between the regulated output voltage conductor and the second input of the error amplifier and operative to provide a single control loop from the regulated output voltage conductor to provide the same control signal variation to the gates of the pass transistor and the discharge transistor.

* * * * *